US008902122B2

(12) United States Patent
Luo et al.

(10) Patent No.: US 8,902,122 B2
(45) Date of Patent: Dec. 2, 2014

(54) ELECTRONIC DEVICE EMPLOYING MULTIFUNCTION ANTENNA ASSEMBLY

(75) Inventors: Peng Luo, Shanghai (CN); Jian-Feng Xiao, Shanghai (CN); Xue-Dong Jiang, Shanghai (CN); Jin-Yang Shi, Shanghai (CN)

(73) Assignees: Ambit Microsystems (Shanghai) Ltd., Shanghai (CN); Hon Hai Precision Industry Co., Ltd., New Taipei (TW)

( * ) Notice: Subject to any disclaimer, the term of this patent is extended or adjusted under 35 U.S.C. 154(b) by 255 days.

(21) Appl. No.: 13/411,637

(22) Filed: Mar. 5, 2012

(65) Prior Publication Data

US 2013/0135174 A1 May 30, 2013

(30) Foreign Application Priority Data

Nov. 25, 2011 (CN) ..... 2011 2 0479113

(51) Int. Cl.
*H01Q 1/10* (2006.01)

(52) U.S. Cl.
USPC ..... 343/883; 343/702; 343/889; 343/900; 343/901

(58) Field of Classification Search
USPC ..... 343/702, 883, 889, 900, 901
See application file for complete search history.

(56) References Cited

U.S. PATENT DOCUMENTS

| | | | | |
|---|---|---|---|---|
| 4,987,422 | A * | 1/1991 | Ryan | 343/713 |
| 5,136,302 | A * | 8/1992 | Chin et al. | 343/702 |
| 6,262,684 | B1 * | 7/2001 | Stewart et al. | 343/702 |
| 2008/0094290 | A1 * | 4/2008 | Wen et al. | 343/702 |

* cited by examiner

*Primary Examiner* — Dameon E Levi
*Assistant Examiner* — Harold L Rappaport
(74) *Attorney, Agent, or Firm* — Novak Druce Connolly Bove + Quigg LLP

(57) ABSTRACT

An electronic device defines a receiving groove for an antenna, a first opening, and a second opening. The first opening and the second opening are at two opposite ends of the receiving groove, and allow an antenna assembly to be extended or retracted in the receiving groove to allow the electronic device to receive different types of wireless signals.

15 Claims, 11 Drawing Sheets

ELECTRONIC DEVICE EMPLOYING MULTIFUNCTION ANTENNA ASSEMBLY

BACKGROUND

1. Technical Field

The present disclosure generally relates to electronic devices, and more particularly to an electronic device employing a multifunction antenna assembly that can transmit many different types of signals.

2. Description of Related Art

Handheld electronic devices, like mobile telephones or personal digital assistants (PDAs), may be designed to be compact and to provide a multitude of functions. These devices often include powerful antennas to transceive radio frequency (RF) signals. However, any one device employs only one type of antenna to transceive a signal. For example, if one device has only one type of antenna, then that handheld electronic device cannot transceive both frequency modulation (FM) signals and multimedia broadcasting signals, such as those of China Mobile Communications.

Therefore, a need exists to overcome the above-described limitations and extended the functionality.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the views.

DETAILED DESCRIPTION

Figure 1:
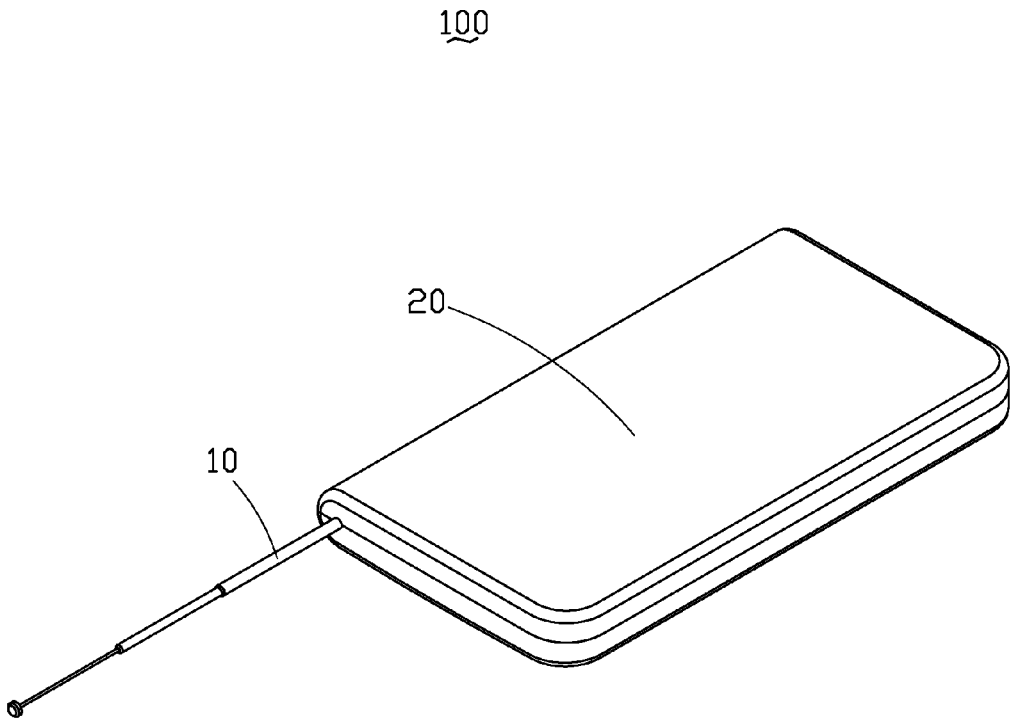
FIG. 1 is a schematic view of an electronic device of an exemplary embodiment of the disclosure.

The embodiments described herein are illustrated by way of example and not by way of limitation in the figures of the accompanying drawings, in which like reference numerals indicate the same or similar elements. References to "an" or "one" embodiment in this disclosure are not necessarily to the same embodiment, and such references can mean "at least one."

Figure 2:
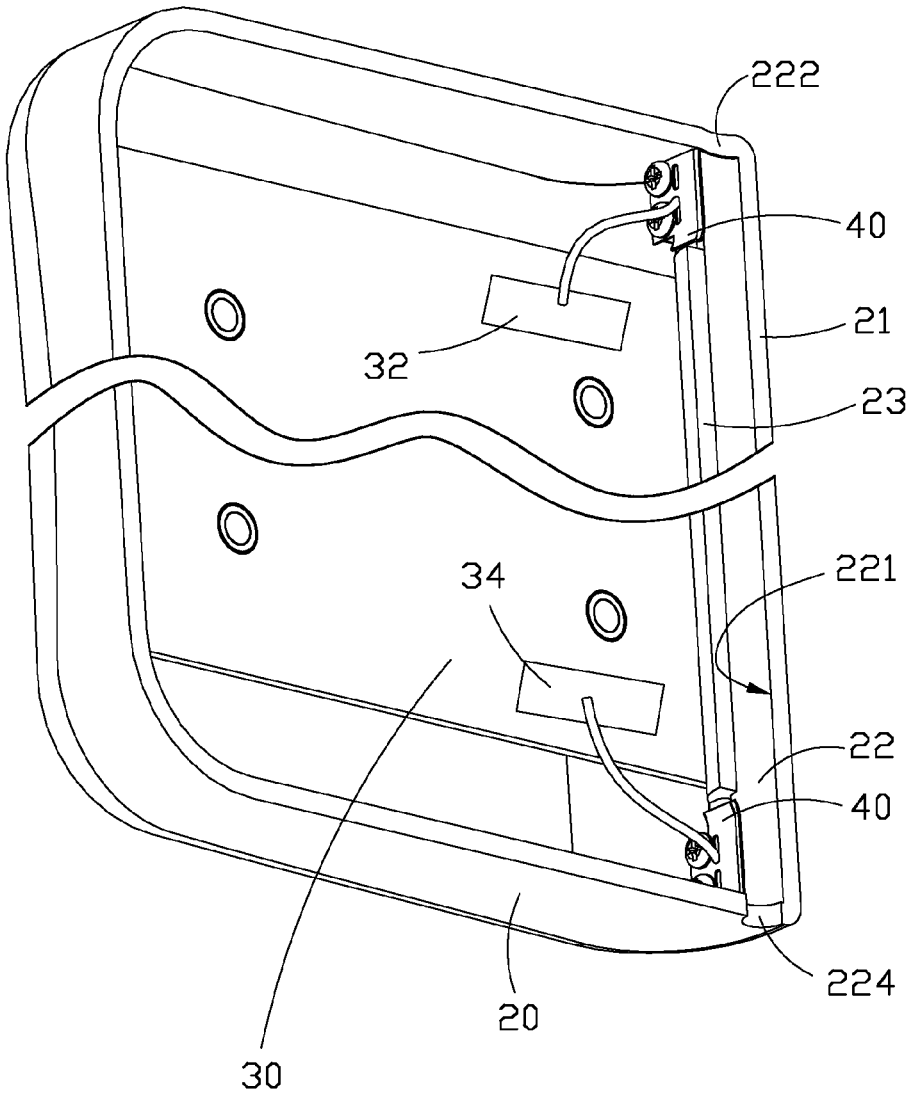
FIG. 2 is a schematic view of a housing of the electronic device of FIG. 1, showing an inner structure of the housing.

Referring to FIGS. 1-2, an electronic device 100 comprises an antenna assembly 10, a housing 20, a printed circuit board (PCB) 30 fixed in the housing 20, and a pair of conductive clips 40 fixed in the housing 20 and electrically connected to the PCB 30. The housing 20 defines a receiving groove 22, a first opening 222, and a second opening 224. The first opening 222 and the second opening 224 are respectively located at two opposite ends of the receiving groove 22 and communicate the receiving groove 22 with the exterior of the housing 20. In this embodiment, the electronic device 100 comprises a baffle 23, formed in the housing 20, close to and parallel with a side wall 21 of the housing 20. The receiving groove 22 is formed between the baffle 23 and the side wall 21 of the housing 20. The antenna assembly 10 is received in the receiving groove 22 and enabled to be pulled out from the first opening 222 and from the second opening 224. The baffle 23 separates the antenna assembly 10 from the PCB 30.

The pair of conductive clips 40 are fixed to the baffle 23 and extend into the receiving groove 22. The pair of conductive clips 40 are fabricated from conductive material(s). In this embodiment, the pair of conductive clips 40 may be fabricated from a deformable or elastic metal sheet and bent into the receiving groove 22. In this embodiment, the pair of conductive clips 40 are respectively adjacent to the first opening 222 and the second opening 224. When the antenna assembly 10 is pulled out from the first opening 222 or the second opening 224, a corresponding one of the pair of conductive clips 40 and the side wall 21 cooperatively clip the antenna assembly 10 to electrically connect the antenna assembly 10 to the PCB 30.

The electronic device 100 further comprises a first transceiving module 32 and a second transceiving module 34 configured on the PCB 30 and respectively electrically connected to the pair of conductive clips 40 to process signals from the antenna assembly 10. In this embodiment, the first transceiving module 32 is configured as a mobile multimedia broadcasting (MMB) module, and the second transceiving module 34 is configured as a frequency modulation (FM) module.

The antenna assembly 10 is slidable in the receiving groove 22 under an external force, such as by means of hand or finger pressure, and arranged as a push fit (not friction-free) against an inner surface 221 of the receiving groove 22, that is, the antenna assembly 10 is in tight contact with the inner surface 221. Therefore, the antenna assembly 10 can be positionally maintained in the housing 20 without any external assistance applied thereon, due to friction between the antenna assembly 10 and the inner surface 221 of the receiving groove 22.

Figure 3:
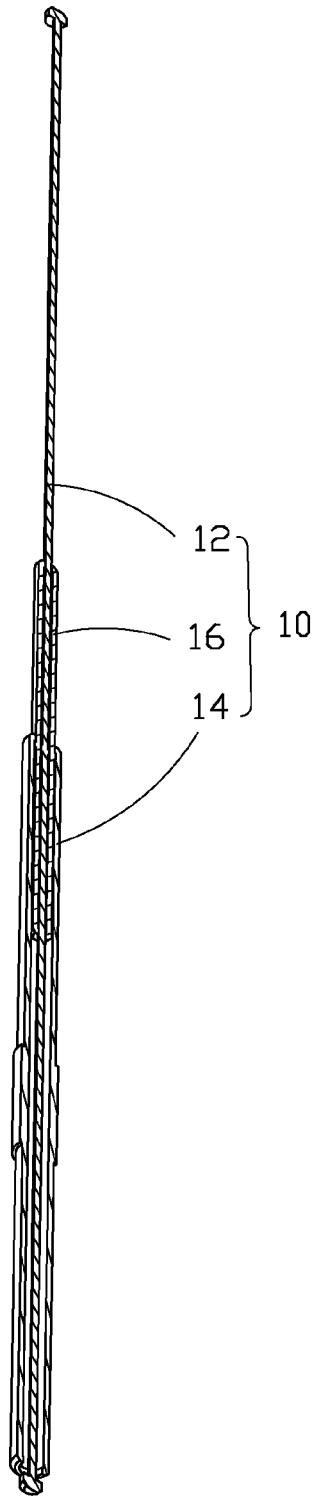
FIG. 3 is a cross-sectional view of an antenna assembly of the electronic device of FIG. 1.

Referring to FIG. 3, the antenna assembly 10 is configured as a bi-directionally retractable and extendable structure and comprises an outer sleeve 14, a middle sleeve 16, and an inner pole 12 nested with each other in turn. That is, the outer sleeve 14, the middle sleeve 16 and the inner pole 12 is assembled from outside to inside. The inner pole 12 is movable along an axial or longitudinal base for extension or retraction of the antenna assembly 10 and drive the outer sleeve 14 to move towards the first opening 222 or the second opening 224 to engage with the corresponding one of the pair of conductive clips 40 to electrically connect the antenna assembly 10 to the PCB 30.

Figure 4:
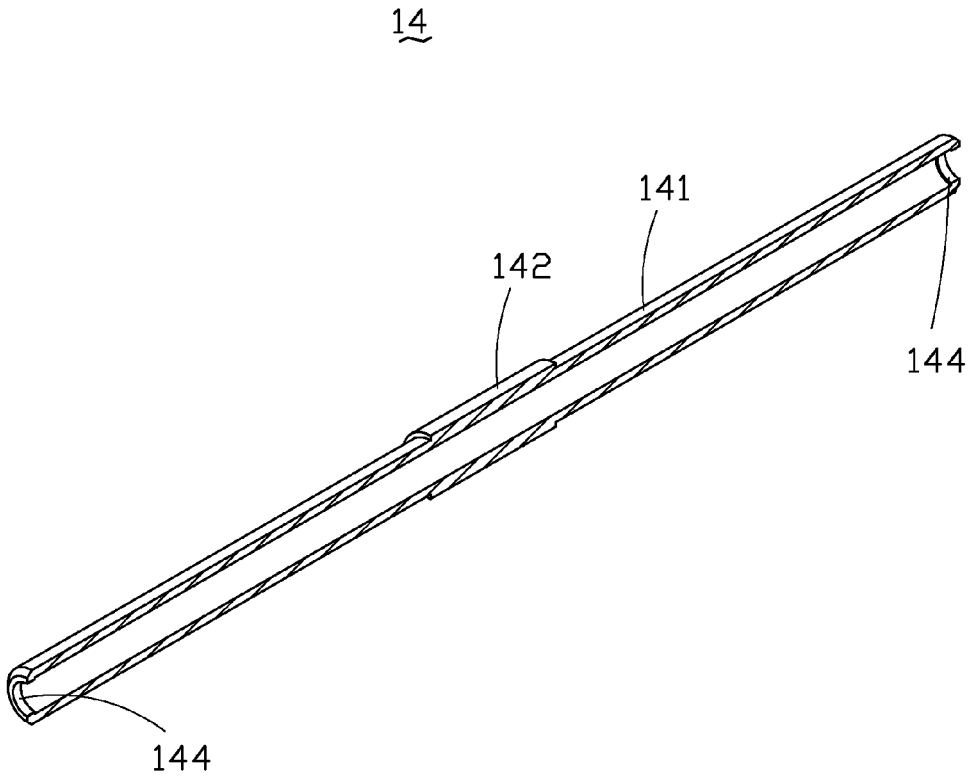
FIG. 4 is a cross-sectional view of an outer sleeve of the antenna assembly of FIG. 3.

Referring to FIG. 4, the outer sleeve 14 comprises a hollow body 141, a conductive portion 142 projecting from the periphery of the hollow body 141 and a pair of stopper portions 144 respectively projecting inwards from two ends of the hollow body 141. The conductive portion 142 makes firm electrical contact with the corresponding one of the pair of conductive clips 40 when the outer sleeve 14 moves outwardly from the first opening 222 or the second opening 224, to be electrically connected to the PCB 30. The pair of stopper portions 144 stop the middle sleeve 16 moving completely out from the outer sleeve 14.

Figure 5:
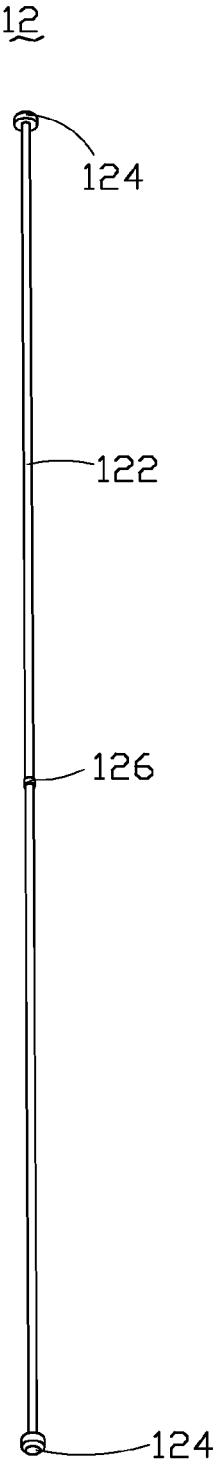
FIG. 5 is a schematic view of an inner pole of the antenna assembly of FIG. 3.

Referring to FIG. 5, the inner pole 12 comprises a post portion 122, a pair of head portions 124 respectively located at two ends of the post portion 122, and a protrusion 126 projecting from periphery of the post portion 122. When the post portion 122 is entirely retracted into the housing 20, the pair of head portions 124 are respectively adjacent to the first opening 222 and the second opening 224 and exposed outside the housing 20.

Figure 6:
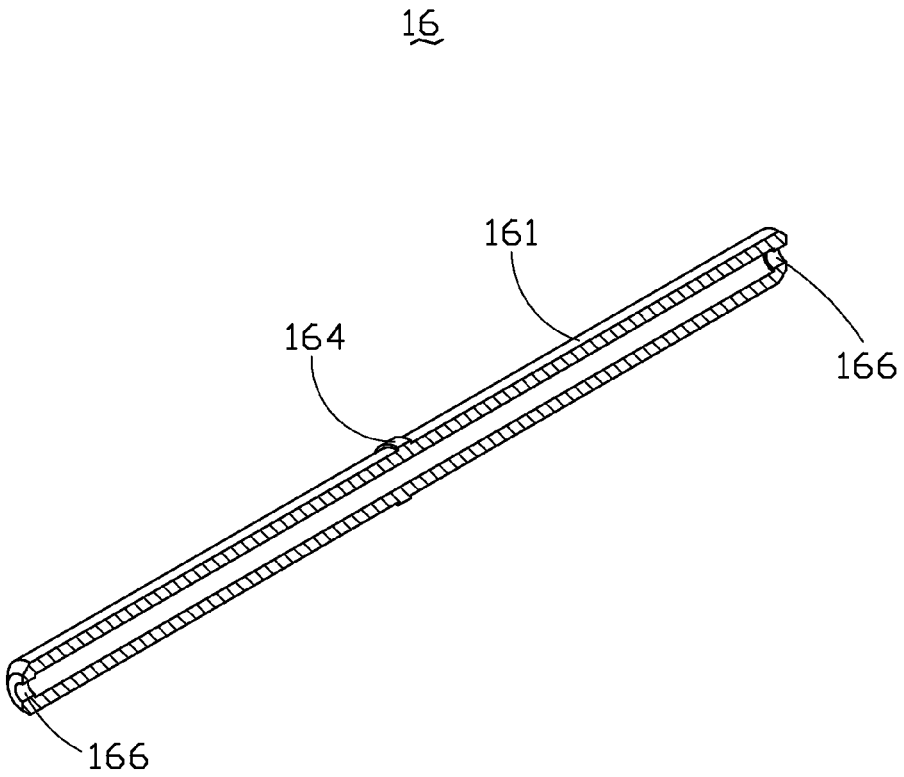
FIG. 6 is a cross-sectional view of a middle sleeve of the antenna assembly of FIG. 3.

Referring to FIG. 6, the middle sleeve 16 comprises a main body 161, a protruding portion 164 projecting from periphery of the main body 161 and a pair of limiting portions 166 respectively projecting inwards from two ends of the main body 161 and enabling to stop the protrusion 126 of the inner pole 12 moving out from the middle sleeve 16. The protruding portion 164 is in close contact with the hollow body 141 of the outer sleeve 14, therefore, the middle sleeve 16 is positionable in relation to the outer sleeve 14, in different positions, by friction between the protruding portion 164 and the hollow body 141. Similarly, the protrusion 126 of the inner pole 12 is in close contact with the main body 161 of the middle sleeve 16, therefore, the inner pole 12 is also positionable in relation to the middle sleeve 16, in different positions, by friction between the protrusion 126 and the main body 161.

Figure 7:
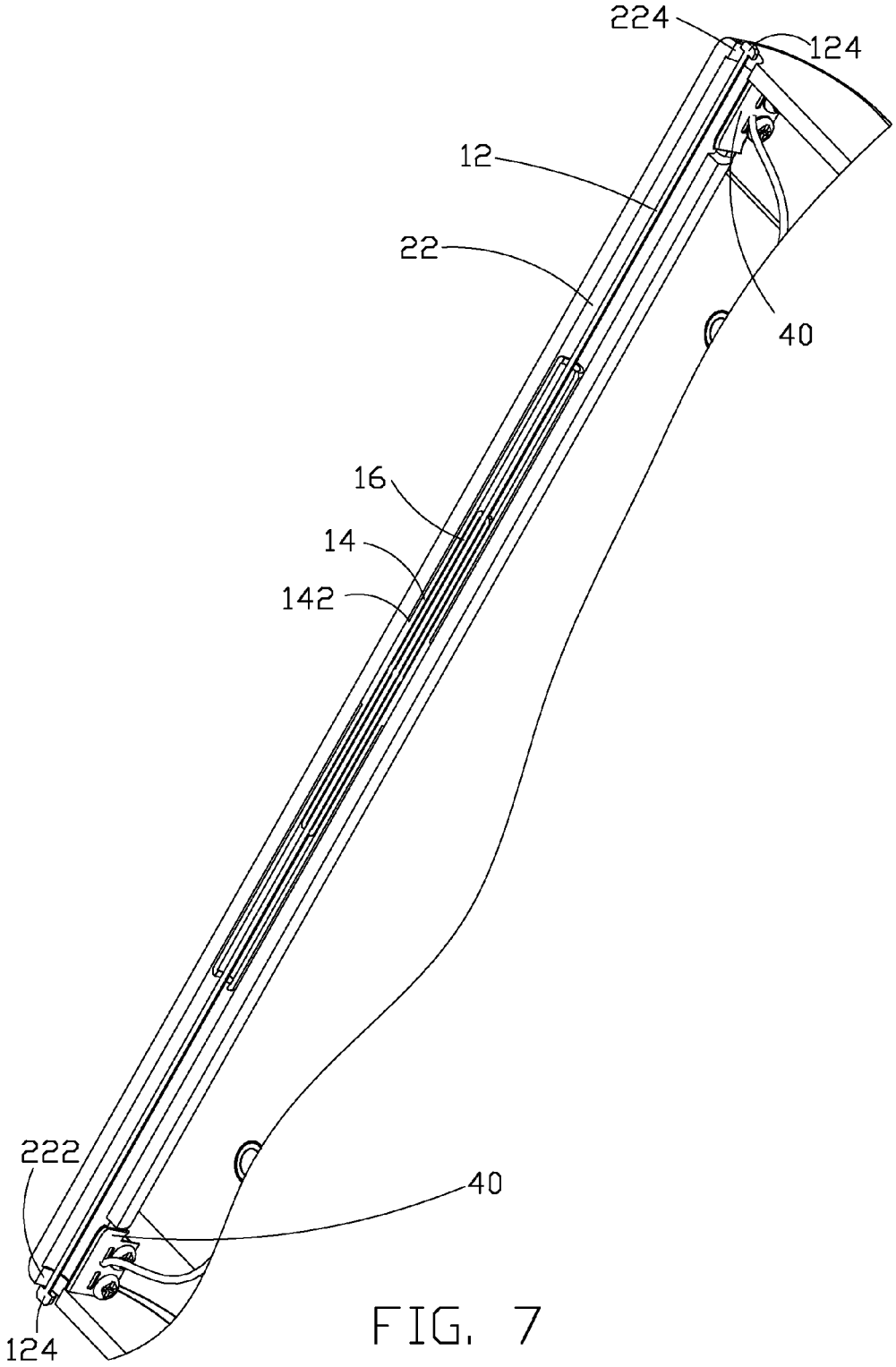
FIG. 7 is an enlarged cross-sectional view of an assembled structure wherein the antenna assembly is mounted into the housing of the electronic device, showing only part of the housing.

Referring to FIG. 7, the post portion 122 of the inner pole 12 of the antenna assembly 10 is entirely retractable in the receiving groove 22 and both head portions 124 of the inner pole 12 are exposed outside the housing 20. The outer sleeve 14 and the middle sleeve 16 are located at middle part of the receiving groove 22. The middle sleeve 16 is received in the outer sleeve 14 and located at middle part of the outer sleeve 14. If no external force is applied on the antenna assembly 10, the antenna assembly 10 can be positioned, and will remain, in the receiving groove 22 due to friction between the inner pole 12, the middle sleeve 16, the outer sleeve 14, and the housing 20.

Figure 8:
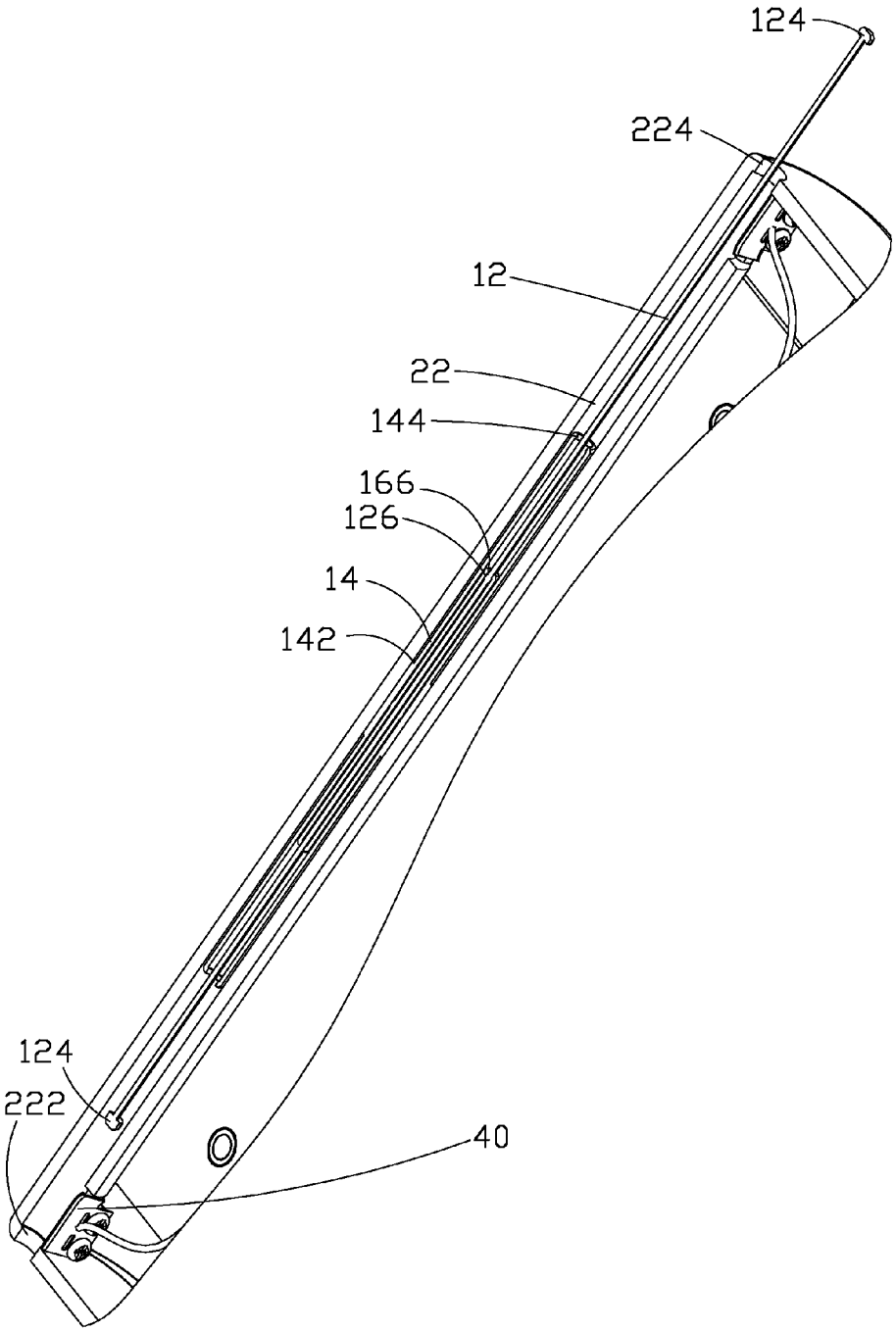
FIG. 8 is similar to FIG. 7, wherein the pole of the antenna assembly is partially pulled out from the housing of the electronic device.
Figure 9:
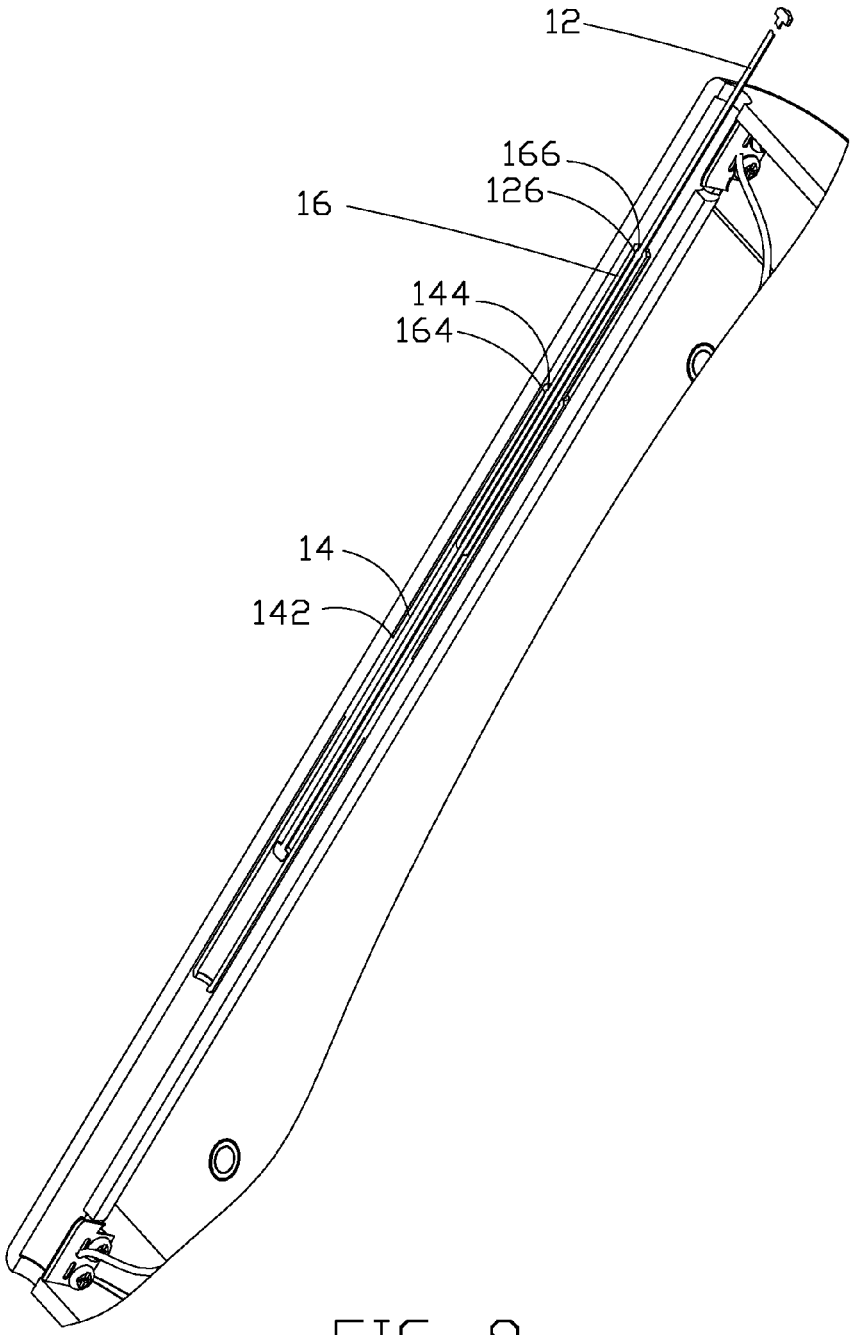
FIG. 9 is similar to FIG. 8, wherein the pole is pulled out to drive the middle sleeve to move out from the outer sleeve.
Figure 10:
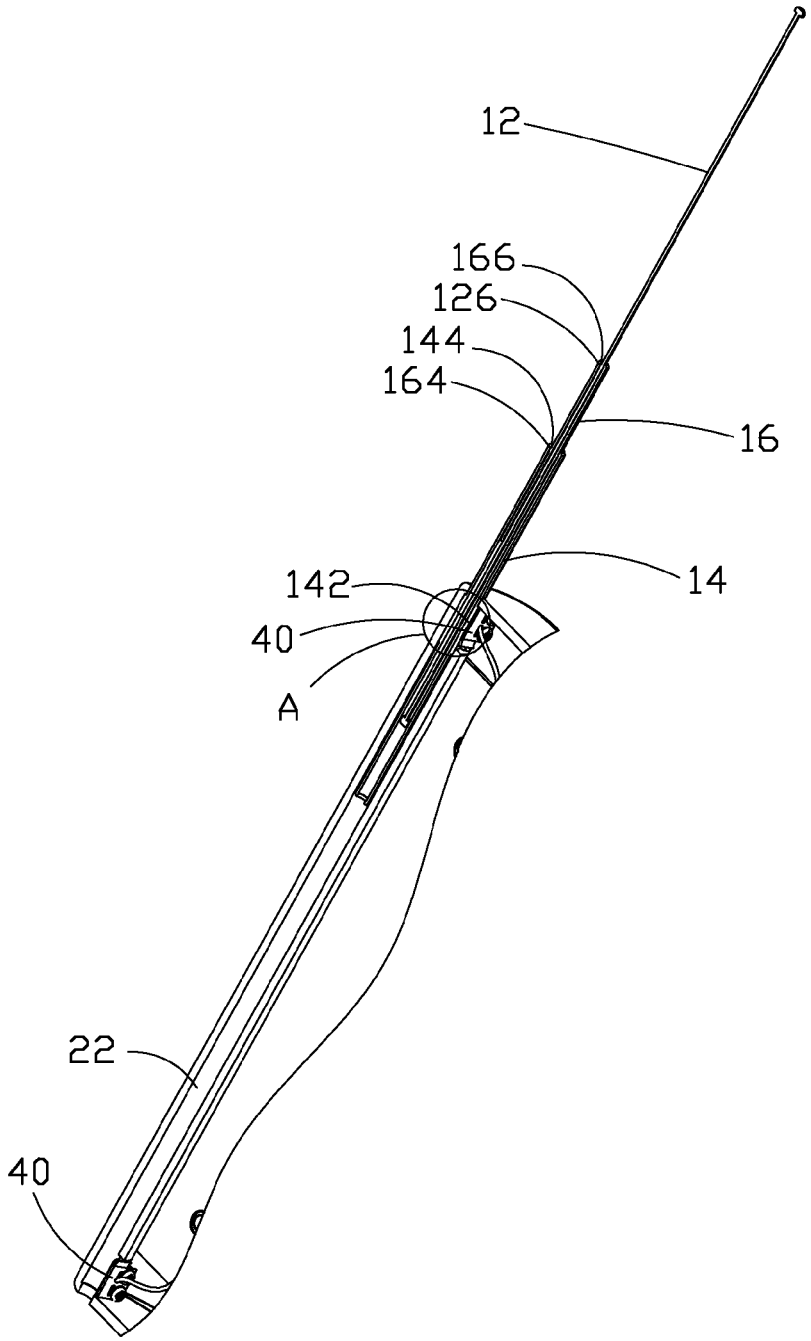
FIG. 10 is a cross-sectional view of FIG. 1, showing part of the housing.
Figure 11:
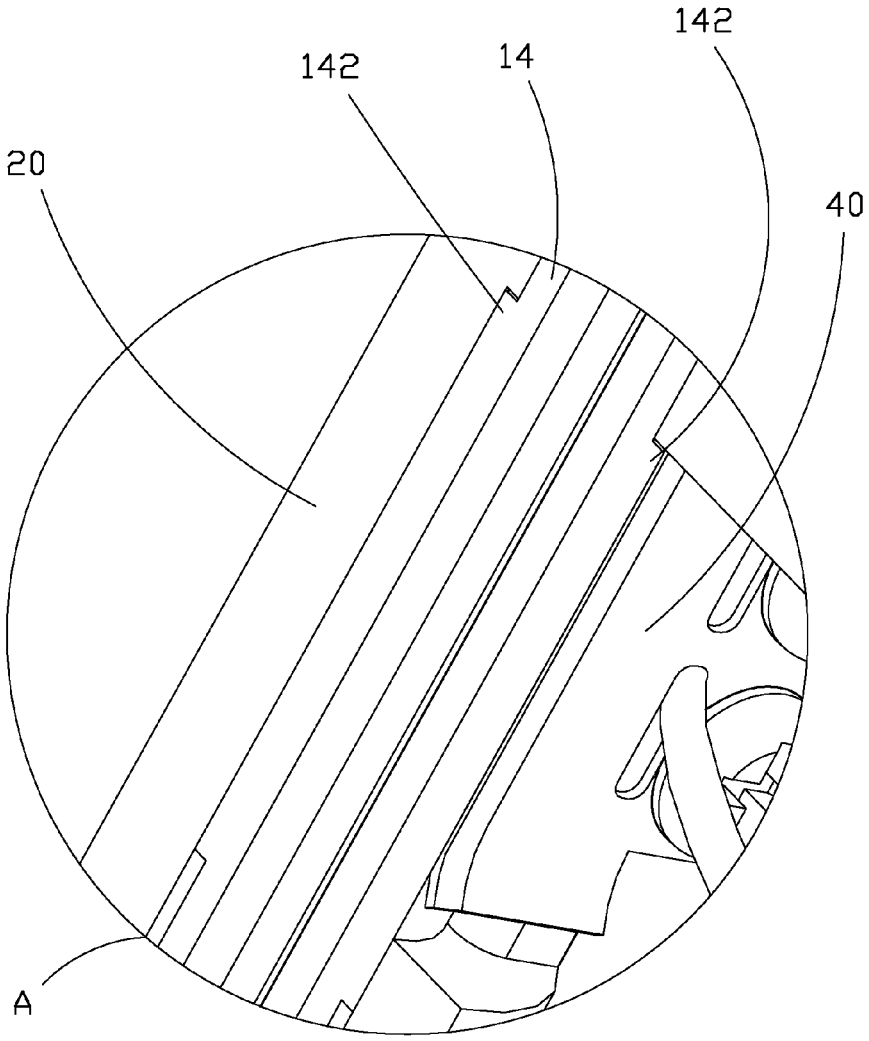
FIG. 11 is an enlarged view of an area labeled A in FIG. 10.

When the inner pole 12 is pulled outwardly from the second opening 224 under an external force along axial direction of the antenna assembly 10, the protrusion 126 of the inner pole 12 is moved towards one of the pair of limiting portions 166. When the protrusion 126 contacts the limiting portion 166, shown in FIG. 8, the protrusion 126 applies force to the limiting portion 166, thereby the inner pole 12 drives the middle sleeve 16 to move towards one of the pair of stopper portions 144. Similarly, when the protruding portion 164 of the middle sleeve 16 contacts the stopper portion 144, shown in FIG. 9, the middle sleeve 16 is enabled to drive the outer sleeve 14 to move towards the second opening 224. Ultimately, the conductive portion 142 of the outer sleeve 14 meets and deforms one of the pair of conductive clips 40, so the conductive portion 142 is clamped between the conductive clip 40 and the housing 20, shown in FIG. 10 and FIG. 11.

The antenna assembly 10 can be selectively pulled out from either the first opening 222 or from the second opening 224. When the antenna assembly 10 is pulled out from the first opening 222 and the conductive portion 142 of the outer sleeve 14 meets one of the conductive clips 40, the antenna assembly 10 electrically connects to the first transceiving module 32 to provide a first antenna function. When the antenna assembly 10 is pulled out from the second opening 224 and the conductive portion 142 of the outer sleeve 14 meets the other conductive clip 40, the antenna assembly 10 electrically connects to the second transceiving module 34 to provide a second antenna function. Thereby, the antenna assembly 10 provides two different types of antenna function, and the electronic device 100 can offer additional functionality.

Although features and elements of the present embodiments are described in particular combinations, each feature or element can be used alone or in other various combinations within the principles of the present disclosure to the full extent indicated by the broad general meaning of the terms in which the appended claims are expressed.

What is claimed is:

1. An electronic device, comprising:

a housing, defining a receiving groove, a first opening, and a second opening, the first opening and the second opening respectively located at two opposite ends of the receiving groove and communicating the receiving groove with an exterior of the housing;

a printed circuit board (PCB), received in the housing;

a pair of conductive clips, fixed in the housing, and electrically connected to the PCB and extending into the receiving groove; and an antenna assembly, received in the receiving groove, the antenna assembly comprising an outer sleeve, a middle sleeve, and an inner pole nested with each other in turn, the inner pole enabled to be moved to provide a relative axial extending or retracting of the antenna assembly and driving the outer sleeve to move towards the first opening or the second opening to engage with the corresponding one of the pair of conductive clips to electrically connect the antenna assembly to the PCB;

wherein the outer sleeve comprises a hollow body and a conductive portion projecting from periphery of the hollow body, and the conductive portion tightly contacts with the corresponding one of the pair of conductive clips by the outer sleeve moving outwardly from the first opening or from the second opening; and wherein when the antenna assembly is pulled out from the first opening or from the second opening, the conductive portion contacting with the corresponding one of the pair of conductive clips to electrically connect the antenna assembly to the PCB.

2. The electronic device of claim 1, further comprising a first transceiving module and a second transceiving module configured on the PCB and respectively electrically connected to the pair of conductive clips to process signals from the antenna assembly.

3. The electronic device of claim 2, wherein the pair of conductive clips are respectively adjacent to the first opening and the second opening.

4. The electronic device of claim 2, wherein the antenna assembly is arranged as a push fit against an inner surface of the receiving groove.

5. The electronic device of claim 1, wherein the inner pole comprises a post portion and a pair of head portions respectively located at two ends of the post portion, wherein the pair of head portions are respectively adjacent to the first opening and the second opening and exposed exterior of the housing when the post portion is entirely retracted in the housing.

6. The electronic device of claim 5, wherein the middle sleeve comprises a main body and a protruding portion projecting from periphery of the main body, and the outer sleeve comprises a pair of stopper portions respectively projecting inwards from two ends of the hollow body and enabling to stop the protruding portion of the middle sleeve moving out from the outer sleeve.

7. The electronic device of claim 6, wherein the middle sleeve is enabled to be positioned to the outer sleeve by friction between the protruding portion of the middle sleeve and the hollow body of the outer sleeve.

8. An electronic device, defining a receiving groove, a first opening, and a second opening, the first opening and the second opening respectively located at two opposite ends of the receiving groove and communicating the receiving groove with exterior of the electronic device, the electronic device comprising an antenna assembly enabled to be retracted in the receiving groove and extended out from the first opening and from the second opening, and the antenna assembly comprising a pair of head portions respectively located at two ends of the antenna assembly and adjacent to the first opening and the second opening.

9. The electronic device of claim 8, further comprising a housing and a baffle adjacent to a side wall of the housing, and the baffle and the side wall cooperatively forming the receiving groove to receive the antenna assembly, a pair of conductive clips fixed to the baffle and extending into the receiving groove, the pair of conductive clips electrically connected to a printed circuit board (PCB) of the electronic device, wherein when the antenna assembly is pulled out from the first opening or from the second opening, the corresponding one of the pair of conductive clips electrically connects the antenna assembly to the PCB.

10. The electronic device of claim 9, wherein the pair of conductive clips are respectively adjacent to the first opening and the second opening.

11. The electronic device of claim 8, wherein the antenna assembly is configured as a bi-directionally retractable and extendable structure.

12. The electronic device of claim 11, wherein the antenna assembly comprises an outer sleeve, a middle sleeve, and an inner pole nested with each other in turn, and the inner pole is enabled to be moved to provide a relative axial extending or retracting of the antenna assembly.

13. The electronic device of claim 12, wherein the inner pole comprises a post portion and a pair of head portions respectively located at two ends of the post portion, when the post portion is entirely retracted in the receiving groove, the pair of head portions are respectively adjacent to the first opening and the second opening and exposed outside of the electronic device.

14. The electronic device of claim 13, wherein the inner pole comprises a protrusion projecting from periphery of the post portion, the middle sleeve comprises a main body and a pair of limiting portion respectively projecting inwards from two ends of the main body and enabling to stop the protrusion of the inner pole moving out from the middle sleeve.

15. The electronic device of claim 14, wherein the inner pole is enabled to be positioned to the middle sleeve by friction between the protrusion of the inner pole and the main body of the middle sleeve.

* * * * *